United States Patent [19]

Gunther

[11] 4,119,297

[45] Oct. 10, 1978

[54] SNUBBING APPARATUS

[76] Inventor: Albert W. Gunther, P.O. Box 615, Harvey, La. 70059

[21] Appl. No.: 777,000

[22] Filed: Mar. 14, 1977

[51] Int. Cl.[2] ..... E21B 33/03

[52] U.S. Cl. ..... 254/29 R; 166/77

[58] Field of Search ..... 254/29 R, 106; 166/77, 166/75 R; 175/9

[56] References Cited

U.S. PATENT DOCUMENTS

| | | | |
|---|---|---|---|
| 1,895,132 | 1/1933 | Minor | 166/77 |
| 3,215,203 | 11/1965 | Sizer | 166/77 |
| 3,757,858 | 9/1973 | Davis et al. | 166/77 |
| 3,797,570 | 3/1974 | Leutwyler | 166/77 |

*Primary Examiner*—Robert C. Watson

*Attorney, Agent, or Firm*—Arnold, White & Durkee

[57] ABSTRACT

Cable-operated snubbing apparatus having a pre-set tension applied to the cables therein via connections to fluid-operated pistons. The pistons are connected to an accumulator for accumulating fluid from the piston cylinders when the draw works of the snubbing apparatus is retracted, thus allowing control by a single rig operator and minimizing horsepower requirements.

13 Claims, 1 Drawing Figure

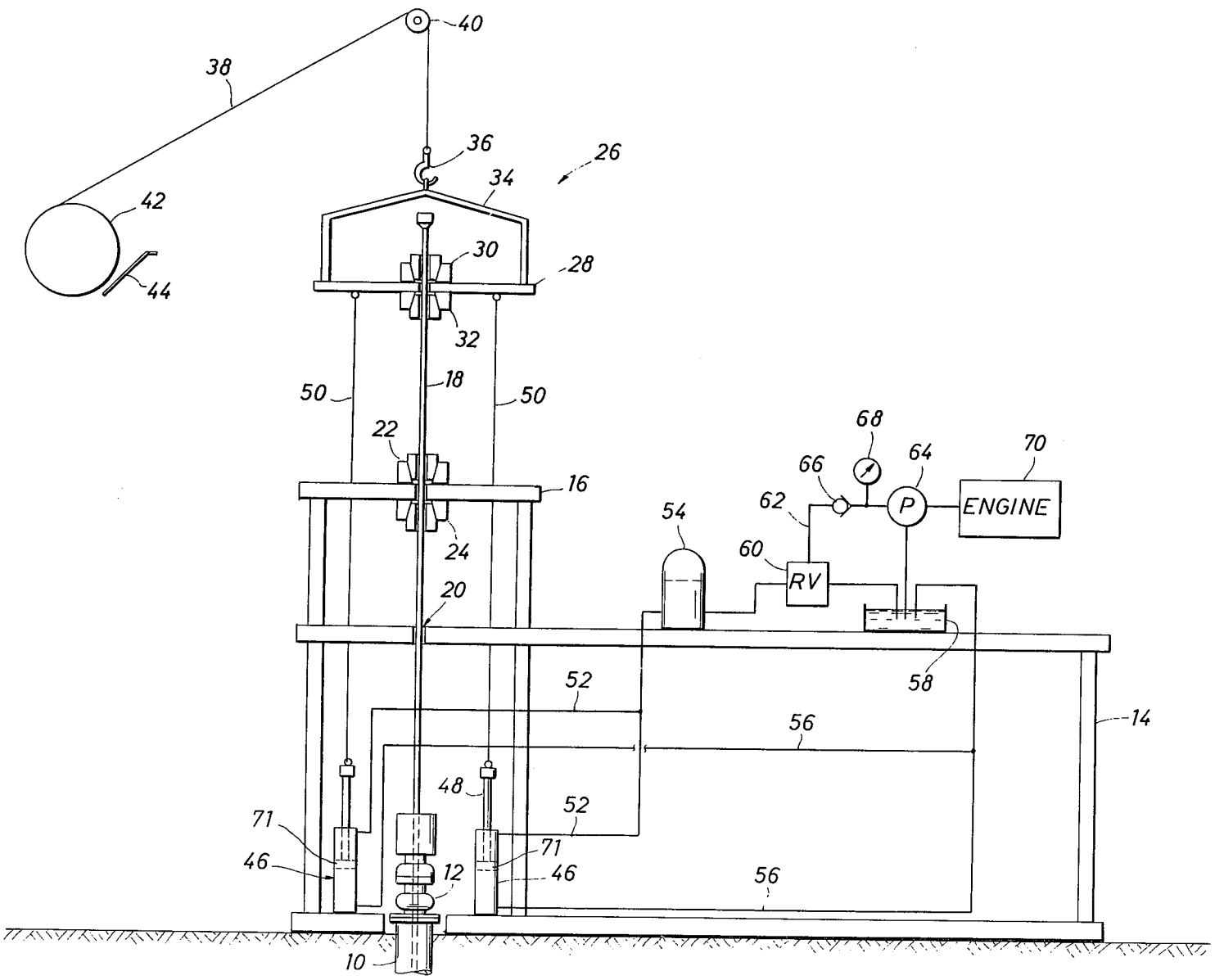
ENGINE
P
RV
10
12
14
16
18
20
22
24
26
28
30
32
34
36
38
40
42
44
46
48
50
52
54
56
58
60
62
64
66
68
70
71

SNUBBING APPARATUS

BACKGROUND OF THE INVENTION

1. Field of the Invention

This invention pertains to pipe lowering and lifting apparatus and particularly such apparatus that operates pipe or other tubular goods into and out of a pressurized well.

2. Description of the Prior Art

It is not uncommon in certain fields to drill through formations wherein effective well pressure conditions in excess of 3000 pounds per square inch are encountered, or to repair wells with pressure on the surface control equipment.

In order to operate tubular goods within a well in the presence of high pressure, it has become the practice to pack off, near the surface, the annular space between the casing and the drill pipe or other tubular goods operating within the casing and to install a check valve on the end or inside the drill pipe or other tube operating inside the casing. This check valve is installed to permit passage of fluid downward and prevent upward passage of fluid. In the process of lowering a drill pipe into the well, a continuous length is made up length by length. It may be evident that when the length of pipe in the hole with the check valve installed is such that its weight is less than that of the effective well pressure tending to lift it, the pipe must be forced down until sufficient lengths have been added to the top of the pipe to allow the force of gravity to sink it.

Moreover, when the pipe is retracted from the hole, immediately after the pressure balance point has been reached (that is, the point where the pipe has been shortened by lifting it and unjoining lengths from the top until the weight of the pipe left in the hole just balances the effective force of the well pressure tending to lift it), the well pressure tends to eject the pipe from the casing.

The forceful entry of the pipe until after the balance point is passed by adding sufficient pipe lengths to overcome the lifting force of the well pressure, is termed "snubbing in", and the control of the movement of the pipe under the influence of well pressure in coming out, is termed "snubbing out". The apparatus that is provided to permit control in snubbing in and snubbing out is referred to as snubbing apparatus or merely as the "snubber". It will be realized that with high well pressures, the lifting force exerted on the pipe may become tremendous and if not kept under control could easily result in damage causing great delays and even result in disaster.

To ensure control over a pipe in the above-described environment, it is conventional to employ unidirectional grippers referred to in the industry as "slips". Such slips are similar to a chuck and are used to hold the pipe against movement in either one direction or the other. When two sets of slips are placed back-to-back, they then hold the pipe against movement in either direction. It is further conventional to employ such sets or pairs of slips at two locations: (1) on a vertical traveling table or support (herein referred to as the traveling support) and (2) on a stationary platform or support. Hence, it may be seen, that during a snubbing operation the slips on the stationary support are released while the slips on the vertical traveling support are in their gripping state. Once the stroke is complete, then the slips on the stationary support are actuated to grip the pipe and the slips on the traveling support are released to allow for repositioning of the traveling support with respect to the pipe for another stroke.

In normal operation in the absence of pressure (or when the pipe is of sufficient length that operation is below the pressure balance point), there is no need to be able to apply downward pressure in addition to that applied by gravity to the pipe. The traveling support is suspended on the cable usually provided on a conventional drilling rig or rig used in well repair or servicing. The cable is reeled onto or off of a conventional winch drum complete with brake and clutches to enable the operator to lower or hoist the traveling support. This conventional winch with its accessories is commonly called the "draw works". The draw works provides adequate pipe hoisting and lowering capability when well pressure is not a factor. When well pressure is a factor, external means is applied to the pipe to push the pipe into the well. This pushing down is usually done by sophisticated machines under control of others than the rig operator.

For example, one common method employed to provide downward pressure is to provide a plug in the pipe, normally in the form of a check valve, and pump drilling fluid through the pipe. Pump pressure in excess of well pressure causes pumped fluid to enter the pipe and travel downward through the check valve. This method leaves the pipe at atmospheric pressure above the check valve and at well pressure below the check valve. Hence, succeeding lengths of pipe can be screwed together and forced into the well without loss of pressure through the bore of the pipe.

In the more sophisticated rigs, hydraulic, pneumatic or electrical driving means is provided for applying both upward as well as downward force to the pipe. In some hydraulic rigs, accumulators are used to provide energy storage of the hydraulic fluid during hydraulic piston retraction. This provides an energy saving that would not otherwise be available. Such rigs, although more automated than the more simple rigs described above, are usually much heavier and require more time to set up and take down. Further, in the event of malfunction, repairs are more time consuming and costly, causing expensive rig downtime, as well.

Further, control over the applied hydraulic pressure is via gauges observable to the operator, but not to others.

Therefore, it is a feature of the present invention to provide an improved snubbing apparatus that allows the rig operator to have control over applying positive pressure during both "snubbing in" and "snubbing out" operations.

It is still another feature of the present invention to provide an improved snubbing apparatus using a push-pull cable arrangement on the traveling support, the cables kept in constant tension, to provide visual means to the rig workers that operation of the traveling support is satisfactory.

It is yet another feature of the present invention to provide an improved snubbing apparatus for applying both downward and upward pressure and using hydraulic pistons cable-connected to the underneath side of the traveling support that work in conjunction with the cable from which the traveling support is suspended.

It is still another feature of the present invention to provide an improved snubbing apparatus which maintains a preset tension in operating cables, at least one cable being connected to a hydraulic piston, the piston, in turn, being connected to an accumulator to provide energy conservation to rig operation.

It is yet another feature of the present invention to provide an improved snubbing apparatus suitable for adapting to almost any conventional rig and providing positive control to the rig operator in the form of lightweight, highly efficient and easy to set up equipment.

SUMMARY OF THE INVENTION

To force pipe or other tubular goods into a well against pressure a vertically traveling support table is provided with two sets of back-to-back, unidirectional pipe grippers, or slips, that prevent the pipe from moving upwardly or downwardly with respect to the support table. The support table is connected for urging the table downwardly, and hence the held pipe into the well, by the use of hydraulic cylinders secured through cables to the underneath side of the traveling support table. Another cable is attached for upward movement of the support table to a drum or winch. To apply downward pressure on the pipe, fluid force or pressure is applied to the cylinders from an accumulator, thereby increasing the tension in the first-mentioned cables and moving the table in a downward direction. A pump or other prime mover maintains a suitable pressure charge on the accumulator. The fluid is normally oil or other suitable hydraulic fluid. Tension is maintained on the opposite cable (the one connected for upward movement) via the winch.

When the rig operator wishes to lift the pipe from the well, the winch is operated so that the tension of the winch cable increases, thereby overcoming the downward pressure and effecting the closing of the hydraulic cylinders. Fluid is forced into the accumulator from the closing cylinders until a predetermined pressure is reached therein, at which time a relief valve opens to dump the fluid back into a reservoir. Hence, the pressure in the accumulator cannot exceed a predetermined level, this level also preventing the tension in the cables operating with the cylinders from exceeding a predetermined or pre-set level.

Hence, the rig operator is in complete control of the snubbing apparatus. Moreover, he maintains visual assurance that the rig is operating properly without relying on gauges or other personnel and, via the accumulator, the horsepower requirements for the system are minimized.

BRIEF DESCRIPTION OF THE DRAWING

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawing, which drawing forms a part of the specification. It is to be understood, however, that the appended drawing illustrates only a typical embodiment of the invention and is therefore not to be considered limiting of its scope, for the invention may admit to other equally effective embodiments.

In the drawing, the FIGURE illustrates, schematically, the invention in a snubbing apparatus as applied to a rig operating in conjunction with an oil or gas well.

DESCRIPTION OF PREFERRED EMBODIMENT

Now referring to the drawing, a well casing 10 in an oil or gas borehole is pressurized so as to require ingress and egress of tubular goods with respect to casing 10 via a conventional Christmas tree 12, which includes appropriate blow out preventers and/or stripping units and valves. The tubular goods operable in conjunction with rig about to be described include rods, drill pipe and the like. For convenience, all such tubular goods are referred to herein merely as "pipe".

The snubbing apparatus to be described hereinafter, which for simplicity may be referred to occasionally merely as "the rig", is mounted on a convenient support framework 14, which is stationary with respect to the casing head. Mounted on framework 14 over the casing head is stationary support 16, having an appropriate opening therein to permit holding and passage of a joint of pipe 18. Other openings, such as at opening 20, are provided in framework 14 to permit pipe 18 to be lowered into and removed from well casing 10.

Fixedly secured to stationary support 16 are two sets of grippers, or slips, 22 and 24. These slips may be of conventional structure. Slips 24 are mounted in such a manner to prevent pipe 18 from moving upwardly with respect thereto when in the engaged or gripping condition. Slips 22 are mounted "inverted" or back-to-back with respect to slips 24 so as to prevent pipe 18 from moving downwardly with respect thereto when they are in the engaged or gripping condition.

Traveling table or support 26 is positioned over stationary support 16, the platform or table portion 28 thereof having an opening therethrough to permit passage of pipe 18. Slips 30 and 32, respectively identical to slips 22 and 24, are fixedly secured to the traveling table.

Bracket 34 of traveling table 26 includes a connection 36 to which rig hoisting cable 38 is secured. Hence, cable 38, which may pass over a rig crown block 40, suspends traveling table 26 in the desired location. Cable 38 is wound about drum or rig winch 42, which includes power means for applying a lifting force to cable 38. Of course, the rig winch also includes an appropriate rig brake 44.

Located in the vicinity of the casing head, and along side thereof, are hydraulic cylinders 46. Although two are shown, the system is operable with only one. More than two may also be employed. Rods 48 with pistons 71 attached and inside cylinders 46 operate into and out of the top of cylinders 46. Cables 50 are connected to the exposed ends of rods 48 and are passed up through appropriate openings in framework 14 and stationary support 16 to be secured to the underneath side of platform 28 of traveling table 26.

Hydraulic lines are connected to both the top end and bottom end of cylinders 46, lines 52 connected to the top end of the cylinders leading to accumulator 54. The bottom end of the cylinders are connected by lines 56 to a reservoir or tank 58. This may be an oil supply tank in conventional hydraulic system.

Accumulator 54 is connected to an adjustable relief valve 60, which, in turn, has its high pressure side connected to accumulator 54 and its low pressure side connected to reservoir 58. A source supply line 62 to relief valve 60 is connected to hydraulic pump 64 through a check valve 66. Pump 64 is connected to draw fluid from reservoir 58. An appropriate gauge 68 may be provided to monitor the pressure supplied from pump 64. A convenient engine 70 or other prime mover supplies the required power for operating pump 64.

In operation to lower pipe 18 into the well casing, hydraulic pump 64 takes oil from reservoir 58 and pressurizes accumulator 54 through check valve 66 and relief valve 60. This causes fluid pressure to be applied through lines 52 to the pistons inside cylinders 46, which retracts rods 48. The retraction of rods 48 causes the tension in cables 50 to overcome the tension in cable 38 and the pressure in the well casing to lower traveling table 26 and to thereby force pipe 18 downward into the casing. To assist in the performance of this task, slips 30 and 32 are engaged and slips 22 and 24 are disengaged.

When the cylinders have been filled, and rods 48 fully retracted, the operation of the slips is reversed, i.e., slips 22 and 24 are engaged and slips 30 and 32 are disengaged. Traveling table 26 is lifted for a new stroke by increasing the force in cable 38 to be greater than the tension in cables 50 through winching of drum 42. When table 26 moves upward, rod 48 with pistons 71 attached move upward to thereby force oil from cylinders 46 through lines 52 back into accumulator 54.

Energy is stored in accumulator 54 in conventional fashion. Typically, gas is entrapped in the upper part of the accumulator. Pressure is applied back against relief valve 60, too, but this valve does not immediately open. Relief valve 60 does open, however, when a predetermined level has been reached, to dump surplus oil back into reservoir 58. Check valve 66 prevents back pressure from being applied to pump 64. Note that via gravity, fluid, not under pressure, is allowed to fill the lower end of cylinders 46 via lines to provide even lubricating action of these cylinders.

The pressure operation of relief valve 60 is adjustable, the setting determining the pressure to be applied through lines 52 and hence the tension in cables 50 to be overcome by the tension in cable 38 in order to move table 26 upwards thereagainst. The pressure setting of relief valve 60 actually causes a substantially constant preset tension in cables 50. The rig operator then increases or decreases the tension in cable 38 with respect thereto by spooling or unspooling the cable to cause lifting or lowering of table 26.

The above slip manipulation described stroking of the snubbing apparatus to lower the pipe. Reverse setting and releasing operating of the slips will cause raisings of the pipe.

It may be seen that a slacking in the tension of cables 50 will be an indication to the rig operator that there is a malfunction in the system. A greater than normal tension in cables 50 will likewise be sensed by the rig operator in operating opposing cable 38 in push-pull fashion to also indicate a malfunction of the system. All of this is evident without having to watch gauges, which would thereby distract the rig operator from observing the pipe manipulations.

It may be seen that the apparatus just described is simple and readily installable and adaptable for use on almost any drilling and/or workover rig.

While a particular embodiment of the invention has been shown and described, it will be understood that the invention, as shown and described, operating with cylinders 46 to pretension cables 50 is not limited thereto. This constant pretensioning of cables 50 may also be accomplished with hydraulic or air operated winch drums, and hence this constant pretensioning of cables 50 is not limited to action by cylinders 46.

What is claimed is:

1. Snubbing apparatus for lowering pipe into a pressurized well and for raising such pipe therefrom, comprising vertical traveling means releasably secured to the pipe, raising means secured fraulic or air operated winch drums, and hence this constant pretensioning of cables 50 is not limited to action by cylinders 46.

fluid piston means operating beneath said vertical traveling means, and a cable secured for downward movement of said vertical traveling means and to said piston means to effect lowering of said vertical traveling means with the application of fluid force to said piston means, the application of a raising force by said raising means overcoming the fluid force applied to said piston means causing the raising of said vertical traveling means.

2. Snubbing apparatus as described in claim 1, wherein said vertical traveling means includes gripper means for ensuring that the pipe does not fall into the well in the presence of insufficient pressure and for ensuring that the pipe is not ejected from the well in the presence of excessive pressure.

3. Snubbing apparatus as described in claim 2, wherein said gripper means includes first unidirectional slips to prevent undesirable downward pipe movement and second oppositely unidirectional slips to prevent undesirable upward pipe movement.

4. Snubbing apparatus as described in claim 1 and including stationary gripper means for holding the pipe when said vertical traveling means is released from the pipe for position adjustment.

5. Snubbing apparatus as described in claim 1, wherein said raising means includes a winch driven cable.

6. Snubbing apparatus as described in claim 1, wherein said fluid piston means is hydraulically operated.

7. Snubbing apparatus as described in claim 1, wherein said fluid piston means is pneumatically operated.

8. Snubbing apparatus as described in claim 1, wherein said fluid piston means includes a stationarily mounted cylinder, a piston operating within the top end of said cylinder, the exposed end of said piston being connected to said cable, and fluid pressure means connected to the top end of said cylinder for effecting a lowering force on said vertical traveling means.

9. Snubbing apparatus as described in claim 8, wherein said fluid pressure means includes a fluid accumulator, such that an upward force on said cable connected to said piston over a predetermined level overcomes the pressure in said piston cylinder to cause fluid to flow from said piston cylinder to be stored in said accumulator and increasing the pressure therein.

10. Snubbing apparatus as described in claim 9, wherein said fluid pressure means includes a relief valve, the high pressure side thereof being connected to said accumulator, a fluid reservoir connected to the low pressure side of said relief valve, and a pump connected to said reservoir for applying pressure through said relief valve to said accumulator, pressure in said accumulator in excess of a predetermined level, causing flow through said relief valve to said reservoir.

11. Snubbing apparatus as described in claim 10, wherein the bottom end of said cylinder is connected to said reservoir for ensuring against the development of pressure differential with the pressure of the fluid in the top end of said cylinder during operation of said piston.

12. Snubbing apparatus as described in claim 1, wherein said fluid force is substantially constant during the raising and lowering of said vertical traveling means, thereby maintaining a substantially constant preset tension to said cable.

13. Snubbing apparatus as described in claim 1, and including at least an additional cable secured to the underneath side of said vertical traveling means and an additional fluid piston means connected thereto and operating therewith.

* * * * *

UNITED STATES PATENT AND TRADEMARK OFFICE

CERTIFICATE OF CORRECTION

PATENT NO. : 4,119,297

DATED : October 10, 1978

INVENTOR(S) : Albert W. Gunther

It is certified that error appears in the above-identified patent and that said Letters Patent are hereby corrected as shown below:

In the Claims

Claim 1, Column 6, Line 3, after secured delete "fraulic or air operated winch drums, and hence this constant pre-tensioning of cables 50 is not limited to action by cylinders 46." and insert--for upward movement of said vertical traveling means,--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*